US008671479B2

(12) United States Patent
Huttner et al.

(10) Patent No.: US 8,671,479 B2
(45) Date of Patent: Mar. 18, 2014

(54) VACUUM PATIENT POSITIONING CUSHION WITH INTEGRATED RIGID OR SEMI-RIGID POSITIONING ELEMENT

(75) Inventors: James J. Huttner, Sylvania, OH (US); Edward Markewitz, Twinsburg, OH (US)

(73) Assignee: Bionix Development Corporation, Toledo, OH (US)

( * ) Notice: Subject to any disclaimer, the term of this patent is extended or adjusted under 35 U.S.C. 154(b) by 0 days.

(21) Appl. No.: 13/100,322

(22) Filed: May 4, 2011

(65) Prior Publication Data

US 2011/0271451 A1 Nov. 10, 2011

Related U.S. Application Data

(60) Provisional application No. 61/332,910, filed on May 10, 2010.

(51) Int. Cl.
*A47C 20/00* (2006.01)

(52) U.S. Cl.
USPC ..... 5/630; 5/655.9; 5/644; 5/648; 5/654; 5/655.4

(58) Field of Classification Search
USPC ..... 5/640, 644, 648, 654, 655.4, 655.9, 706
See application file for complete search history.

(56) References Cited

U.S. PATENT DOCUMENTS

| | | | | |
|---|---|---|---|---|
| 3,748,669 | A * | 7/1973 | Warner | 5/682 |
| 4,045,830 | A * | 9/1977 | Loeb et al. | 5/81.1 T |
| 5,689,844 | A * | 11/1997 | Liu | 5/636 |
| 5,832,550 | A * | 11/1998 | Hauger et al. | 5/621 |
| 5,845,352 | A * | 12/1998 | Matsler et al. | 5/654 |
| 6,159,172 | A * | 12/2000 | Gray et al. | 5/709 |
| 6,197,099 | B1 * | 3/2001 | Pearce | 5/644 |
| 6,226,820 | B1 * | 5/2001 | Navarro | 5/655.5 |
| 2003/0200609 | A1 * | 10/2003 | Jusiak et al. | 5/655.4 |
| 2007/0083995 | A1 * | 4/2007 | Purdy et al. | 5/702 |

OTHER PUBLICATIONS

Bionix Development Corporation, Radiation Therapy—SecureVac Immobilization System, http://www.bionixrt.com/RT_Pages/SecureVac.html, prior to May 10, 2010.

* cited by examiner

*Primary Examiner* — Robert G Santos
*Assistant Examiner* — David E Sosnowski
(74) *Attorney, Agent, or Firm* — Marshall & Melhorn, LLC

(57) ABSTRACT

A vacuum patient positioning cushion includes an integrated rigid or semi-rigid positioning element located within a gas-impermeable outer cover, making it possible to easily and correctly position a patient for a radiation therapy or other procedure without the need or use of external positioning devices. The gas-impermeable outer covering defines an air-tight enclosure having a valve stem and closeable vacuum control valve in selective fluid communication with the enclosure. The enclosure houses a filler material and a rigid or semi-rigid positioning element. A method of positioning a patient using the vacuum patient positioning cushion is also provided.

5 Claims, 1 Drawing Sheet

VACUUM PATIENT POSITIONING CUSHION WITH INTEGRATED RIGID OR SEMI-RIGID POSITIONING ELEMENT

CROSS-REFERENCE TO RELATED APPLICATIONS

This application is claiming the benefit, under 35 U.S.C. §119(e), of the provisional application filed May 10, 2010 under 35 U.S.C. §111(b), which was granted Ser. No. 61/332,910. This provisional application is hereby incorporated by reference in its entirety.

BACKGROUND OF THE INVENTION

Vacuum cushions for positioning patients for radiation therapy procedures are well known and widely used. These cushions are comprised of several common elements: a gas-impermeable outer cover, valve-stem and closeable valve, and expanded polystyrene beads that fill the cushion. In use, the patient is positioned on the cushion while it is in its semi-inflated, loose state. A source of vacuum, usually a vacuum pump, is attached to the closeable valve. As the cushion is evacuated, the expanded polystyrene beads are forced together to form a rigid support that conforms to the body contour of the patient. If desired, the expanded polystyrene beads may be bunched-up around a portion of the patient's anatomy, a thigh for example, so that when the beads become rigid they will hold that portion of the patient's anatomy in the desired position.

Such vacuum cushions come in a variety of sizes, fill rates, and configurations to fit the sizes and contours for different body portions, including a size large enough to hold the entire patient. A problem arises, however, in that it becomes difficult to correctly elevate and/or position some body parts like thighs and knees without over-filling the cushion with polystyrene beads, which would make it difficult to position other body elements like the torso that do not need elevation. This can lead to the need to position a solid or rigid positioner such as a wedge or other form underneath the vacuum cushion to properly elevate and position knees and thighs.

SUMMARY OF THE INVENTION

The current invention discloses a vacuum patient positioning cushion with an integrated rigid or semi-rigid positioning element located within the gas-impermeable outer cover, making it possible to easily and correctly position a patient for a radiation therapy or other procedure without the need or use of external positioning devices.

The invention is a vacuum cushion for positioning a patient for a procedure comprising a gas-impermeable outer covering defining an airtight enclosure, a valve stem and closeable vacuum control valve in selective fluid communication with the enclosure, a filler contained within the enclosure, and a rigid or semi-rigid positioning element positioned within the enclosure.

In another aspect of the invention, a method of positioning a patient comprises placing the patient on a vacuum patient positioning cushion comprised of a gas-impermeable outer covering defining an airtight enclosure containing a filler and a rigid or semi-rigid positioning element, with said vacuum patient positioning cushion being partly or completely in an inflated condition. The integrated rigid or semi-rigid positioning element is moved within the patient positioning cushion such that it supports a desired portion of the patient. A source of negative pressure is applied to the enclosure while simultaneously manipulating the filler to create a positioning form in a configuration that corresponds to the anatomy of that portion of the patient overlying the positioning cushion and maintaining the integrated rigid or semi-rigid positioning element in position. Then, the enclosure is removed from the source of negative pressure to seal the vacuum patient positioning cushion section in that configuration.

BRIEF DESCRIPTION OF THE DRAWINGS

The advantages of the invention will become readily apparent to those skilled in the art from the following detailed description of various embodiments when considered in the light of the accompanying drawings, in which.

DETAILED DESCRIPTION OF THE INVENTION

It is to be understood that the specific devices and processes illustrated in the attached drawings and described in the following description are simply exemplary embodiments of the inventive concepts defined in the appended claims. Hence, specific dimensions and other physical characteristics relating to the embodiments disclosed herein should not be considered as limiting, unless the claims expressly state otherwise.

Figure 1:
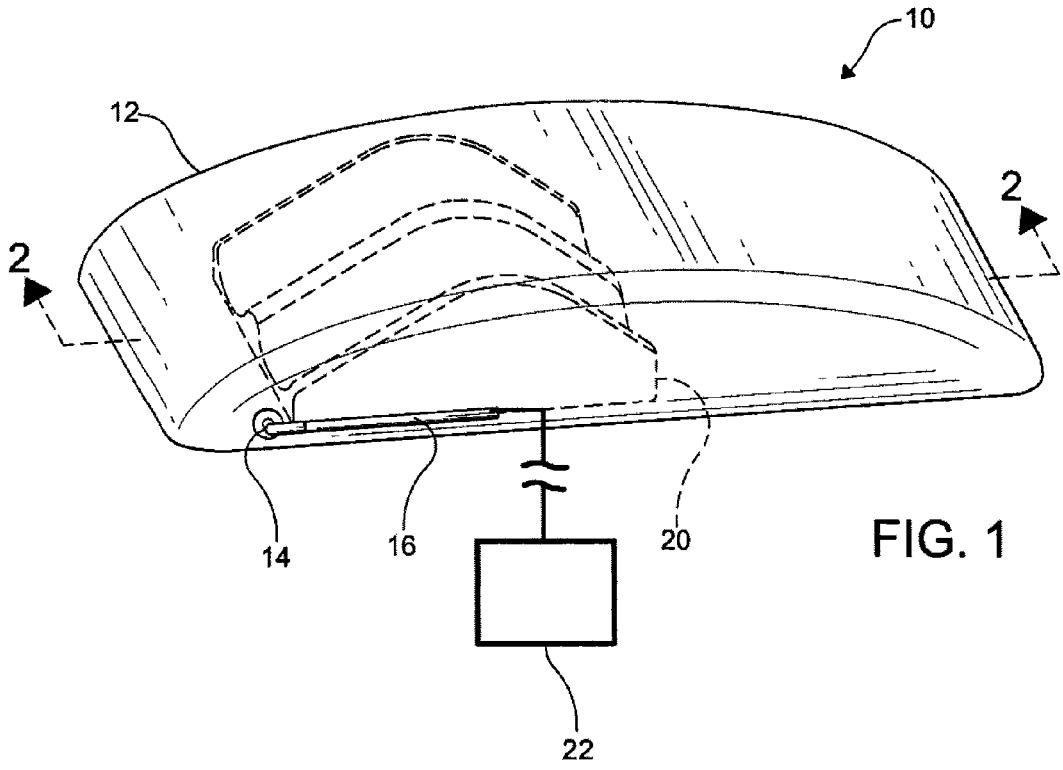
FIG. 1 shows an isometric view of the vacuum patient positioning cushion of the invention.

Referring to the FIG. 1, a preferred embodiment of the vacuum patient positioning cushion 10 of the invention is illustrated. The vacuum patient positioning cushion 10 is formed with a gas-impermeable outer covering 12 that defines an airtight enclosure. A valve stem 14 with closeable valve 16 is secured to the cushion 10 to provide selective fluid communication to the enclosure defined by the outer covering 12. The enclosure is provided with a filler material 18, preferably formed of a plurality of polymeric beads, most preferably a plurality of expanded polystyrene beads. The filler is not show in FIG. 1 for ease of illustration. The fill rate for the filler may vary, depending on the positioning requirements of the particular cushion 10.

A rigid or semi-rigid positioning element 20 is located within the gas-impermeable outer covering 12. The rigid or semi-rigid positioning element 20 may be made of rigid or semi-rigid closed-cell foam or similar material, is radiolucent, and provides additional support and structure for positioning the patient. The integrated rigid or semi-rigid positioning element 20 may be moveable, i.e., loose within the cushion 10, or may be fixed in place through attachment to the gas-impermeable outer covering 12. The integrated rigid or semi-rigid positioning element 20 may be any desired shape, but is preferably wedge shaped, cylindrical, or trapezoidal shaped, or includes a portion having such shape.

Figure 2:
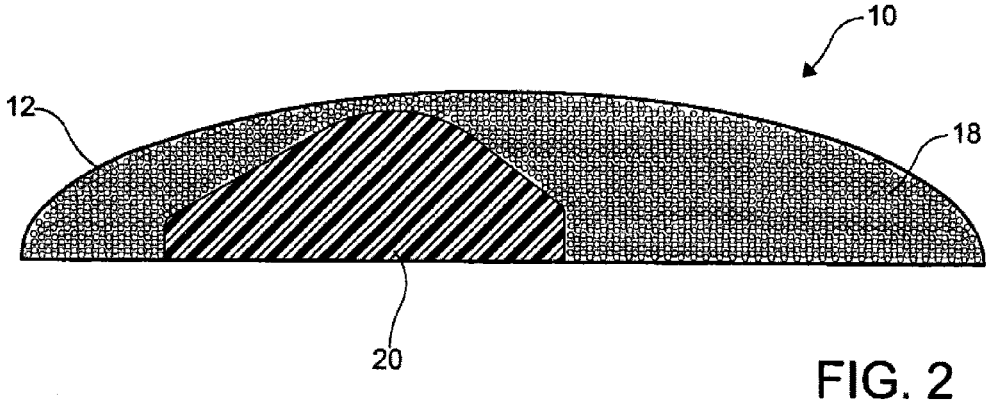
FIG. 2 shows a cross-sectional view of the vacuum patient positioning cushion taken along the line 2-2 of FIG. 1.

As noted, FIG. 2 shows a cross-sectional view of the vacuum patient positioning cushion 10 with integrated rigid or semi-rigid positioning element 20. Again shown are the gas-impermeable outer covering 12 with the rigid or semi-rigid positioning element 20 housed therewithin. The valve 16 and valve stem 14 are not shown in this view. However, in this view the filler material 18 is depicted.

The vacuum patient positioning cushion of the invention may be used to position a portion or all of the body of a patient. In accordance with the method of invention, some portion of the body of the patient is placed on the vacuum patient positioning cushion with the being partly or completely in the inflated condition. The integrated positioning element housed within the patient positioning cushion is positioned such that it supports the desired body part(s) of the patient. A means of producing a vacuum (shown schematically as 22 in FIG. 1) such as a vacuum pump is attached to the vacuum control valve, and a vacuum is applied to begin evacuation of the enclosure while simultaneously manipulating the filler within the cushion to create a positioning form in a configuration that corresponds to the anatomy of that portion of the patient overlying the cushion and maintaining the integrated positioning element in place. Then, the source of vacuum is removed to seal the vacuum patient positioning cushion section in that configuration.

In accordance with the provisions of the patent statutes, the invention has been described in what is considered to represent its preferred embodiments. However, it should be noted that the invention could be practiced otherwise than as specifically illustrated and described without departing from its spirit or scope. As an example, it will be appreciated that, in those embodiments in which the apparatus includes a plurality of projections, the size and shape of the projections may vary considerably.

What is claimed is:

1. A vacuum cushion for positioning a patient for a procedure comprising:

a gas-impermeable outer covering within which an airtight chamber is defined;

a source of negative pressure;

a vacuum control valve to provide selective fluid communication between the chamber and the source of negative pressure;

a filler material comprised of a plurality of polymeric beads contained within the chamber and in selective fluid communication with the source of negative pressure; and a radiolucent rigid or semi-rigid positioning element comprising closed-cell foam positioned within the chamber and in selective fluid communication with the source of negative pressure; wherein the rigid or semi-rigid positioning element is shaped and configured to support at least an appendage of a patient; and wherein the filler material substantially surrounds the rigid or semi-rigid positioning element.

2. The vacuum patient positioning cushion of claim 1, wherein the positioning element is located within the chamber in such a fashion that it is not fixed in position, and can be moved to a plurality of locations within the chamber.

3. The vacuum patient positioning cushion of claim 1, wherein the positioning element is located in a fixed position within the chamber.

4. The vacuum patient positioning cushion of claim 1, wherein the polymeric beads are expanded polystyrene beads.

5. The vacuum patient positioning cushion of claim 1, wherein the rigid or semi-rigid positioning element is wedge shaped and has at least two separate recesses, the recesses each being configured to support an appendage of a patient.

* * * * *